US008549806B2

(12) United States Patent
Snyder

(10) Patent No.: US 8,549,806 B2
(45) **Date of Patent: *Oct. 8, 2013**

(54) INSULATIVE AND WEATHER-RESISTANT BUILDING CONSTRUCTION

(76) Inventor: Leland D. Snyder, Gig Harbor, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/506,309

(22) Filed: Apr. 11, 2012

(65) Prior Publication Data

US 2012/0216473 A1 Aug. 30, 2012

Related U.S. Application Data

(63) Continuation of application No. 12/470,184, filed on May 21, 2009, now abandoned.

(60) Provisional application No. 61/055,229, filed on May 22, 2008.

(51) Int. Cl.
*E04B 1/70* (2006.01)
*E04F 17/00* (2006.01)
*E04D 1/00* (2006.01)

(52) U.S. Cl.
USPC ..... 52/302.1; 52/553

(58) Field of Classification Search
USPC ..... 52/302.1, 551, 553, 95, 198, 199, 302.3
See application file for complete search history.

(56) References Cited

U.S. PATENT DOCUMENTS

| | | | | |
|---|---|---|---|---|
| 3,979,867 | A * | 9/1976 | Sowinski | 52/309.11 |
| 5,973,015 | A * | 10/1999 | Coronado et al. | 521/64 |
| 6,938,383 | B2 * | 9/2005 | Morris et al. | 52/95 |
| 7,117,649 | B2 * | 10/2006 | Morris et al. | 52/302.3 |
| RE39,825 | E * | 9/2007 | Morris et al. | 52/553 |
| 7,617,638 | B1 * | 11/2009 | Slama et al. | 52/95 |
| 2004/0237464 | A1 * | 12/2004 | Khan | 52/782.1 |
| 2005/0000172 | A1 * | 1/2005 | Anderson | 52/198 |
| 2009/0288358 | A1 * | 11/2009 | Snyder | 52/302.1 |

* cited by examiner

*Primary Examiner* — Andrew Triggs
(74) *Attorney, Agent, or Firm* — John S. Hale; Gipple & Hale

(57) ABSTRACT

A building structural component, such as a wall, roof, ceiling, floor, or the like, is resistant to weather and moisture while facilitating the drying and elimination of water vapor and liquid water. The component includes a vapor-permeable membrane that resists penetration of liquids including water, but that permits gases including water vapor to pass through the membrane to resist buildup of moisture in the building component. A batten, such as an insulated batten, forms a cavity in the building component to facilitate air circulation, and reduces heat flow through structural studs of the building component to increase the overall insulation value of the finished component.

16 Claims, 5 Drawing Sheets

INSULATIVE AND WEATHER-RESISTANT BUILDING CONSTRUCTION

CROSS REFERENCE TO RELATED APPLICATION

This is a continuation application claiming priority from U.S. patent application Ser. No. 12/470,184 filed Oct. 21, 2009 and the benefit of U.S. Provisional Application No. 61/055,229 filed May 22, 2008.

FIELD OF THE INVENTION

The present invention relates generally to building structure, and more particularly, to walls, roofs, and other building structures that resist weather and insulate against heat transfer.

BACKGROUND OF THE INVENTION

Buildings are typically constructed with a series of studs or structural members in a spaced arrangement to form walls and roofs. The studs typically have an inner sheet material (such as gypsum board) on one side and an outer façade or cladding on the other side. The inner sheet typically forms the portion of the wall that is visible from inside the building, and the outer sheet forms the façade or siding viewable from the exterior of the building. A layer of insulation material is typically placed between each stud to slow or reduce the building's loss or gain of heat through the wall or roof. However, the studs themselves, and especially studs made from steel or other metals, act as heat conductors or "thermal shorts" through which a significant amount of heat may be gained or lost through the wall or roof. Thus, the overall insulation value of the wall or roof may be significantly lower (i.e., more thermally conductive) than that of the insulation material between the studs. In addition, typical construction methods and materials may lead to entrapment of moisture that can result in formation of mold, mildew, rot, and loss of insulation properties.

SUMMARY OF THE INVENTION

The present invention provides a building structural component that resists weather elements while remaining breathable to gases such as water vapor, to limit or prevent moisture from becoming entrapped in walls, roofs, ceilings, floors, and the like. In addition, the building component may include insulated battens aligned with structural studs to eliminate or substantially reduce heat loss or gain through the studs. In one embodiment, the batten is comprised of an outer structural portion and an inner portion made of highly-insulative material. The outer portion of the batten may be made from a magnesium-based binder mixed with recycled and/or waste materials, and the inner insulative portion made of an aerogel, for example.

According to one aspect of the invention, a building structural component includes a plurality of structural stud or joist members spaced from one another, a sheathing or sheet-like material, a plurality of battens substantially aligned with the stud member, a vapor-permeable membrane, and an exterior siding material. An interior surface of the sheathing is positioned along the exterior surfaces of the stud members. The battens have exterior and interior surfaces and are positioned along the exterior surface of the sheathing in general alignment with the stud members. The vapor-permeable membrane is substantially impervious to liquids and permeable to gases including water vapor. The exterior siding member is positioned along the exterior surfaces of the battens so that the siding member is spaced from the sheathing by the battens. A cavity is thus defined between the siding member and the sheathing. The battens substantially reduce the flow of thermal energy through the structural stud members to thereby increase the insulation value of the building structural component.

Optionally, the vapor-permeable membrane is positioned between the battens and the sheathing, or between the battens and the exterior siding member.

Optionally, one or more vents may be positioned between the battens and the siding member. The vents are coupled to the siding member and permit ventilation of the cavity between the siding member and the sheathing.

Optionally, the battens are insulated and include outer portions and inner insulation portions that are at least partially surrounded by the outer portions. The inner insulation portions may be sized so that their widths exceed the widths of the corresponding stud members, such as at least about 1.5 inches. The outer portion may be made from recycled waste materials and a magnesium-based binder, or from wood or MDF or resin-based materials, for example, while the inner insulation portion may be an aerogel, for example, or other insulative or highly-insulative material.

Thus, the present invention provides a building structural member having low thermal conductivity, even in the regions of structural stud members, and weather resistance combined with breathability that facilitates drying and evaporation of moisture that may be present within the structural member or within the building in which it is used. The batten may include a recess or chamber for receiving a layer of aerogel or other highly insulative material, and may have an outer portion made up of recycled or waste materials mixed with a binder, such as a magnesium-based binder or other materials that may be nonflammable and resistant to deterioration in the presence of moisture and extreme temperatures.

These and other objects, advantages, purposes, and features of the present invention will be become apparent upon review of the specification in conjunction with the drawings.

DESCRIPTION OF THE PREFERRED EMBODIMENTS

Figure 1:
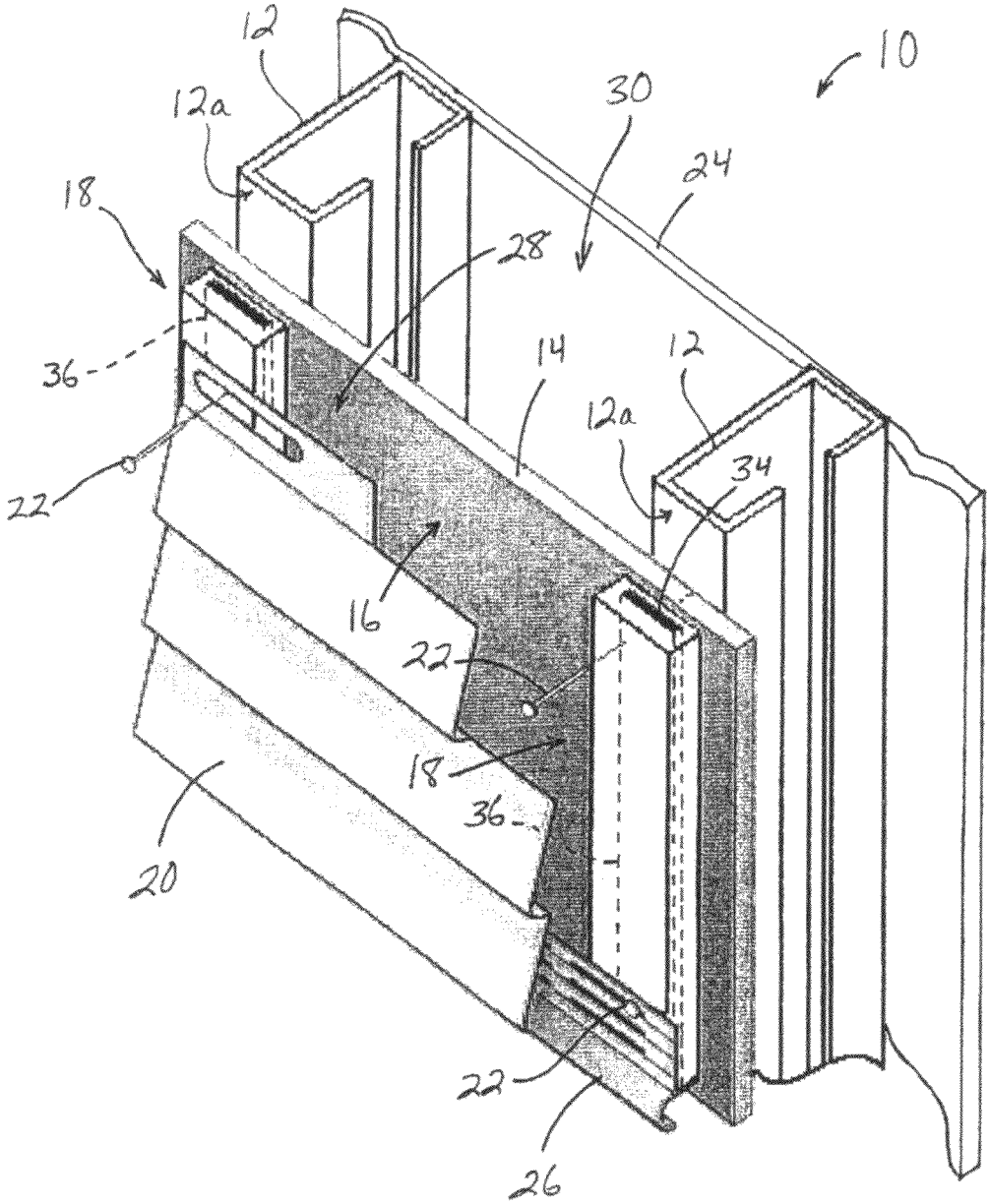
FIG. 1 is a perspective view of a portion of a wall structure in accordance with the present invention.
Figure 2:
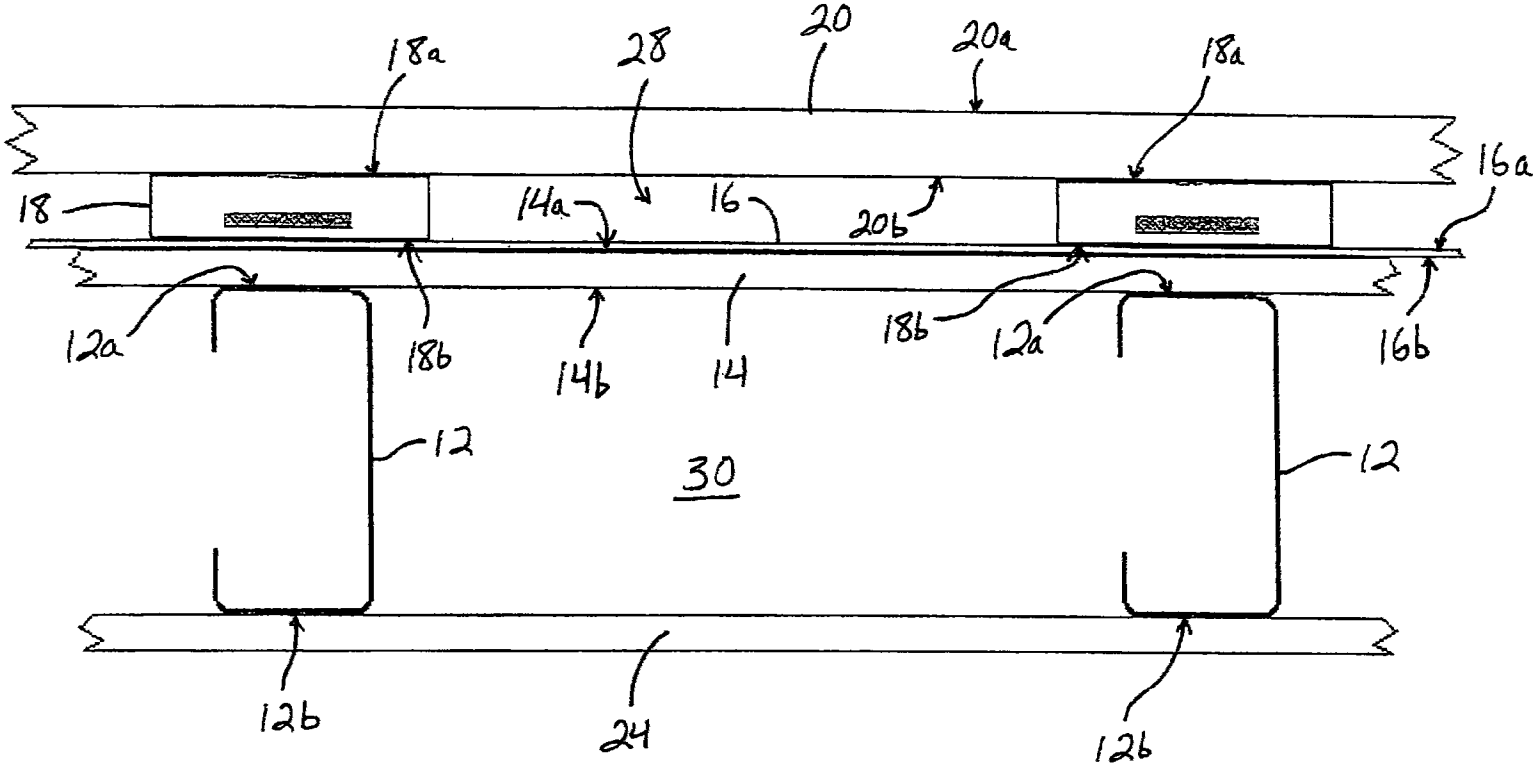
FIG. 2 is a top plan view of the wall structure of FIG. 1.

Referring now to the drawings and the illustrative embodiments depicted therein, a building structural component such as a wall structure 10 includes a plurality of studs 12, a sheathing material 14, a vapor-permeable membrane 16, a plurality of battens 18, and an exterior siding or cladding member 20 forming the outer surface of the wall structure 10 (FIGS. 1 and 2). As will be more fully described below, the configuration and components of wall structure 10 (which represents substantially any building structural component, such as a roof or ceiling of similar construction) provides a breathable structure that resists weather elements while resisting the buildup or entrapment of moisture, and which provides higher overall insulation values by reducing heat flow through studs 12.

In the illustrated embodiment of FIGS. 1 and 2, each component of wall structure 10 includes an outside or exterior surface denoted by the suffix 'a' (such as exterior surfaces 18*a*, 20*a* of battens 18 and exterior siding member 20, respectively) and an inside or interior surface denoted by the suffix 'b' (such as interior surfaces 18*b*, 20*b* of battens 18 and exterior siding member 20, respectively). It will be appreciated that "interior", "exterior" and their equivalents, as used herein (unless otherwise noted), refer to external surfaces of each component and the direction in which the surfaces face relative to a building structure such as a wall or roof, where "exterior" refers to surfaces facing the outside of a building and "interior" refers to surfaces facing the inside of a building.

Wall structure 10 is constructed from studs 12 in spaced arrangement (FIGS. 1 and 2), with interior surfaces 12*b* facing an interior of a building or a room of a building, and exterior surfaces 12*a* facing an exterior of the building. Attached along exterior surfaces 12*a* is sheathing 14 having an interior surface 14*b* facing studs 12. Vapor-permeable membrane 16 is positioned between an exterior surface 14*a* of sheathing 14 and interior surfaces 18*b* of battens 18. Vapor-permeable membrane 16 may be incorporated along exterior surface 14*a* of sheathing 14, or may be a separate membrane that is installed separately from the other components of wall structure 10. Battens 18 are generally aligned with studs 12 and positioned against an exterior surface 16*a* of membrane 16. Exterior siding member 20 is positioned with its interior surface 20*b* positioned against exterior surfaces 18*a* of battens 18. Fasteners 22 such as nails, screws, or the like (FIG. 1) are driven through an exterior surface 20*a* of exterior siding member 20, through battens 18, through vapor-permeable membrane 16, through sheathing 14, and into studs 12 to hold the structure together and fix its components relative to one another.

Optionally, vents 26 (FIG. 1) may be positioned across battens 18 to engage portions of siding 20 and facilitate ventilation of a cavity or air space 28 formed between siding 20 and vapor-permeable membrane 16. Typically, an internal sheathing layer 24, such as gypsum board or the like, forms the inner wall surface of a building or room. Internal sheathing layer 24 closes off a cavity 30 between studs 12 that may typically be filled with insulation material such as fiberglass insulation, high-density fiberglass insulation, mineral wool, cellulose-based insulation, foam insulation or the like.

Exterior siding member 20 provides a weather-resistant surface that resists wind, rain, snow, and other elements. However, siding member 20 is typically not completely impervious to such elements. An air space or cavity 28 defined between sheathing 14 and exterior siding member 20 provides a region substantially devoid of insulation materials (excluding air and battens 18) to permit liquid and vaporous water and/or other elements to pass behind exterior siding member 20 and exit wall structure 10 at vents 26 or via other fluid conduits. The thickness of cavity 28 is primarily determined by the thickness of battens 18, which fix the spacing of exterior siding member 20 and sheathing 14 (and/or membrane 16) relative to one another. Vapor-permeable membrane 16 is a moisture-resistant and gas-permeable weather barrier that resists the flow of air currents and liquid water from outside the wall structure 10 into the region of the wall structure that is on the interior side of interior surface 16*b* of membrane 16, while permitting water vapor and other vaporous or gaseous elements from inside the building to escape through vapor-permeable membrane 16 into the air space 16 and the atmosphere. Thus, wall structure 10 resists the entry of moisture into a room or building defined by the wall structure, while permitting moisture that exists in the building to escape through the wall to resist mildew, mold, rot, loss of insulative properties, and other undesirable side effects of entrapped moisture. As will be described below, wall structure 10 also provides enhanced insulation properties owing substantially to battens 18, which may have highly insulative properties.

It will be appreciated that other configurations of the components of the wall structure (or other building structural component) are envisioned without departing from the spirit and scope of the present invention. For example, and with reference to FIG. 3, vapor-permeable membrane 16 may be positioned between battens 18 and exterior siding member 20 of a wall structure 10', such as to limit or eliminate liquid water reaching cavity 28', which is located between membrane 16, sheathing 14, and battens 18. Optionally, battens 18 may be applied directly to studs 12 to further limit the transmission of heat through the studs via sheathing 14, or may be applied directly to studs 12 at interior surfaces 12*b* while having a similar insulative effect.

Studs 12 are typically steel or alloy or other metal material, particularly when used for commercial building applications, although the studs may also be made of wood or synthetic materials (such as wood-polymer composites), as may be more conventional for residential applications. The term "studs" as used herein is intended to refer to any structural member (including joists, purlins, etc.) in spaced arrangement for constructing a wall, ceiling, roof, floor, or the like, and are not intended to be limited in meaning to studs for wall construction. Studs 12 may be highly thermally conductive, particularly when made of metals, although even wood studs and other more insulative stud materials may be relatively conductive to heat, particularly compared to the high insulation values of insulation materials that fill the cavity 30 between studs 12.

Sheathing 14 may be an exterior-grade gypsum board, or may be made of wood (such as plywood), medium-density fiberboard ("MDF"), or other sheet material that may be used to face exterior surfaces 12*a* of studs 12. Vapor-permeable membrane 16 may be a spun-bonded polypropylene sheet material, for example, such as WallShield® and WrapShield™ brand weatherizing membranes, available from VaproShield, LLC, of Gig Harbor, Wash. As noted above, membrane 16 is substantially impervious to liquids such as water, but is permeable to gases such as water vapor. Battens 18 may be highly insulative, as described in detail below, so as to resist the flow of thermal energy through studs 12. Exterior siding member 26 may be made of various different materials, such as vinyl, aluminum, or wood siding common to some residential applications, or concrete, brick, stone, or corrugated metal façades, for example. It will further be appreciated that the invention may be practiced in other applications, such as ceilings and/or roofs so that the exterior siding member may represent roofing materials such as tarpaper shingles, wood shakes, sheet metal, or substantially any other common roofing material.

In the illustrated embodiments, battens 18 are highly insulative so that when they are aligned with studs 12, they substantially block the transmission of thermal energy through the studs, which may otherwise form a high-conductivity path or "thermal short" for heat or thermal energy to flow through wall structure 10. Although shown and described as being located along outside surfaces of wall studs, it will be appreciated that insulated battens may also be applied to floor joists of insulated floors, for example, without departing from the spirit and scope of the present invention.

Battens 18 include outer portions 32 that provide structure to the battens, and inner insulative portions or members or cores 34. As described above, insulated battens 18 may be positioned or fastened at or near outwardly-facing surfaces 12*a* of studs 12, which form the primary structure of a roof, ceiling, or wall structure 10 (FIG. 1). Battens 18 thus provide a heat barrier that substantially reduces the flow of heat or thermal energy through studs 12 to increase the insulation value of wall structure 10.

Figure 3:
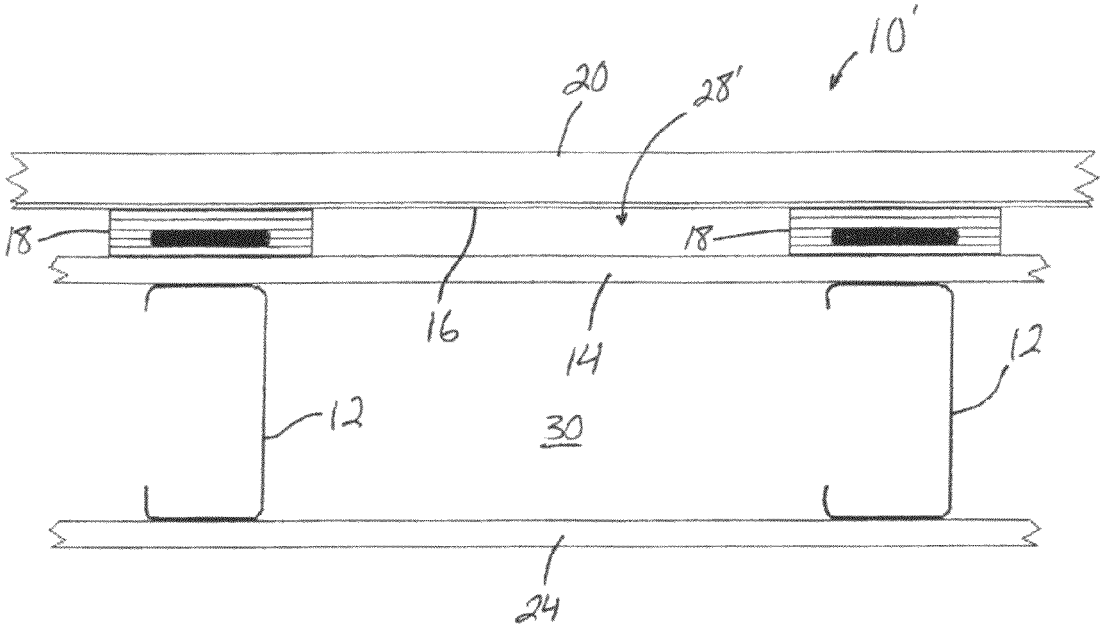
FIG. 3 is a top plan view of a portion of another wall structure.
Figure 4A:
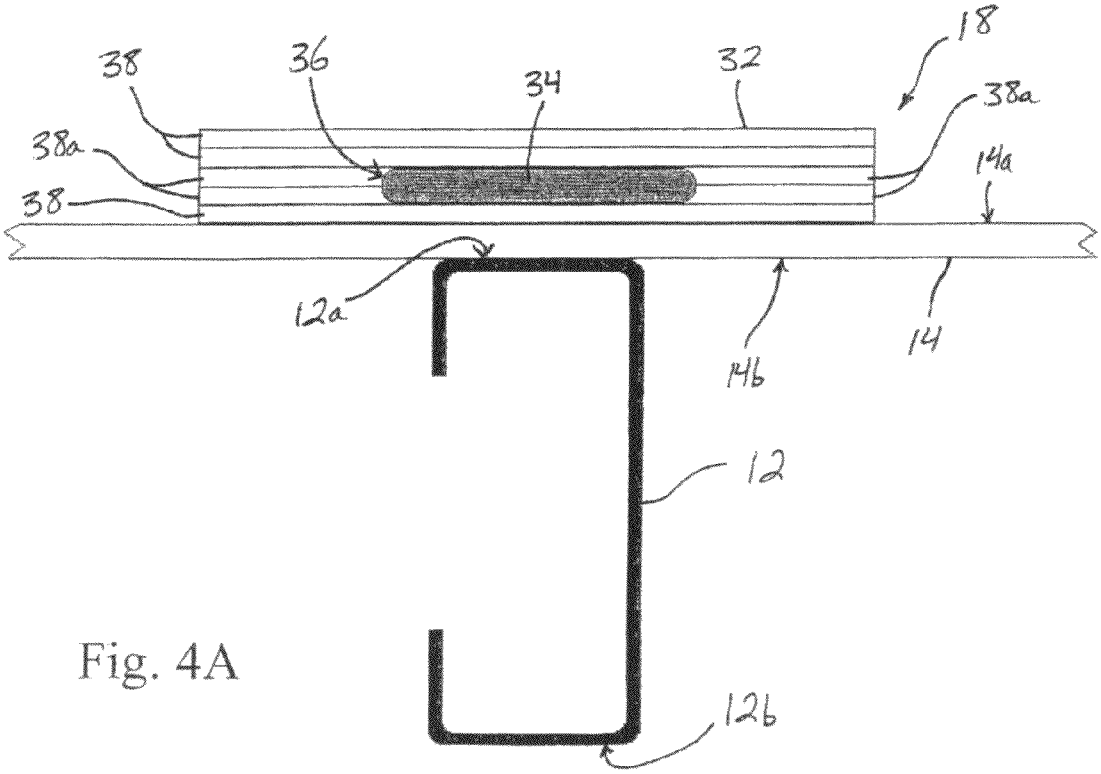
FIG. 4A is a top plan view of a portion of the wall structure of FIG. 1.

As best seen in FIGS. 1 and 4A, each insulated batten 18 has an elongate chamber 36 formed in outer portion 32. Chamber 36 extends longitudinally along substantially the entire length of outer portion 32 and receives insulative portion 34 therein. Optionally, and as best shown in FIGS. 3 and 4A, outer portion 32 may be formed from a plurality of sheets or layers 38 that are fused, bonded, adhered, or fastened together. Outer portion 32 may include one or more reduced-width layers 38*a* (FIG. 4A) that are sandwiched between the other layers 38 to form chamber 36 therebetween. Thus, batten 18 may be formed by building up multiple layers 38, 38*a* to form chamber 36, during which process insulative portion 34 is inserted into chamber 36 before the chamber is fully formed. Battens 18 may be approximately 1 inch thick and approximately 4 inches wide, for example, and extend along the full length of studs 12, such as a length of 8 feet, 10 feet, or substantially any other length. By positioning insulative portion 34 as close as practical to stud 12, the heat flowing into or out of stud 12 and directly through outer portion 32 of batten 18 is reduced. However, it will be appreciated that the position of insulative portion 34 and of batten 18 itself may be adjusted according to the design goals, environmental factors, manufacturability, etc. Thus, insulative portion 34 may be positioned closer to one side of outer portion 32 than the other to reduce the amount of heat that passes through outer portion 32 and around insulative portion 34, as will be described in greater detail.

Outer portion 32 provides a level of rigidity and strength to batten 18, but is not necessarily intended to be completely rigid or load-bearing. Outer portion 32 is intended to house and protect insulative portion 34, and may be given stiffness or enhanced structural properties beyond those of insulative portion 34 to improve handling of batten 18, or to facilitate the attachment of batten 18 to studs 12 and/or to facilitate attachment of other components (such as exterior siding 20 or the like) to batten 18. Outer portion 32 is preferably made from durable, shatter-resistant, nonflammable material that is resistant to deterioration in the presence of moisture and extreme temperatures. Outer portion 32 is also preferably drillable and/or machinable. Optionally, outer portion 32 may be made from a blend of recycled or waste materials combined with a binder to form a hardened, environmentally-friendly, nonflammable material. The binder may be a magnesium-based or magnesium oxide-based binder, such as RenuStone™ or RenuBlox™, available from EnviroProducts International, LLC, of Grand Rapids, Mich. Optionally, and instead of waste-based materials, the outer portion may be made from wood, fiberboard, high density foam, resin-based materials, or the like, or composites of any of the above.

Insulative portion 34 preferably has very low thermal conductivity, such as approximately 0.087 to 0.13 Btu-in/hr-ft$^2$-° F., or about 7.7 to 11.5 in R-value, in order to provide relatively high insulation values with a relatively thin insulative portion. For example, insulative portion 34 may be approximately 0.25 inches thick while maintaining an R-value of approximately 11.5. Insulative portion 14 may have a width that is approximately equal to or greater than the width of studs 16, and less than the width of outer portion 32. For example, the width of insulative portion 14 would preferably be about 1.5 to 2 inches or greater when applied to a typical "two-by-four" wooden stud that is about 1.5 inches thick. Suitable insulative materials include aerogels such as Spaceloft® brand aerogel, available from Aspen Aerogels, Inc. of Northborough, Mass., although other insulative or highly-insulative materials may also be used.

Accordingly, battens 18 substantially limit or block the transmission of heat or thermal energy through studs of a wall structure or roof structure in order to lower the overall thermal conductivity of such structures. The outer portions 32 of battens 18 at least partially surround or encase insulative portions 34 in order to provide a relatively thin, highly insulative layer along or near the studs of a wall or roof structure. The battens may be fastened to the studs with fasteners driven through the battens in a conventional manner, and therefore may be readily integrated into wall or roof structures. Further, the outer portions 32 of battens 18 may have a high content of processed waste or recycled materials to form battens that are durable, shatter-resistant, nonflammable, inexpensive, moisture resistant, and receptive to fasteners such as screws and nails. The use of highly insulative materials, such as aerogels, permits battens 18 to be formed as relatively thin structures while retaining high insulation values.

Figure 4B:
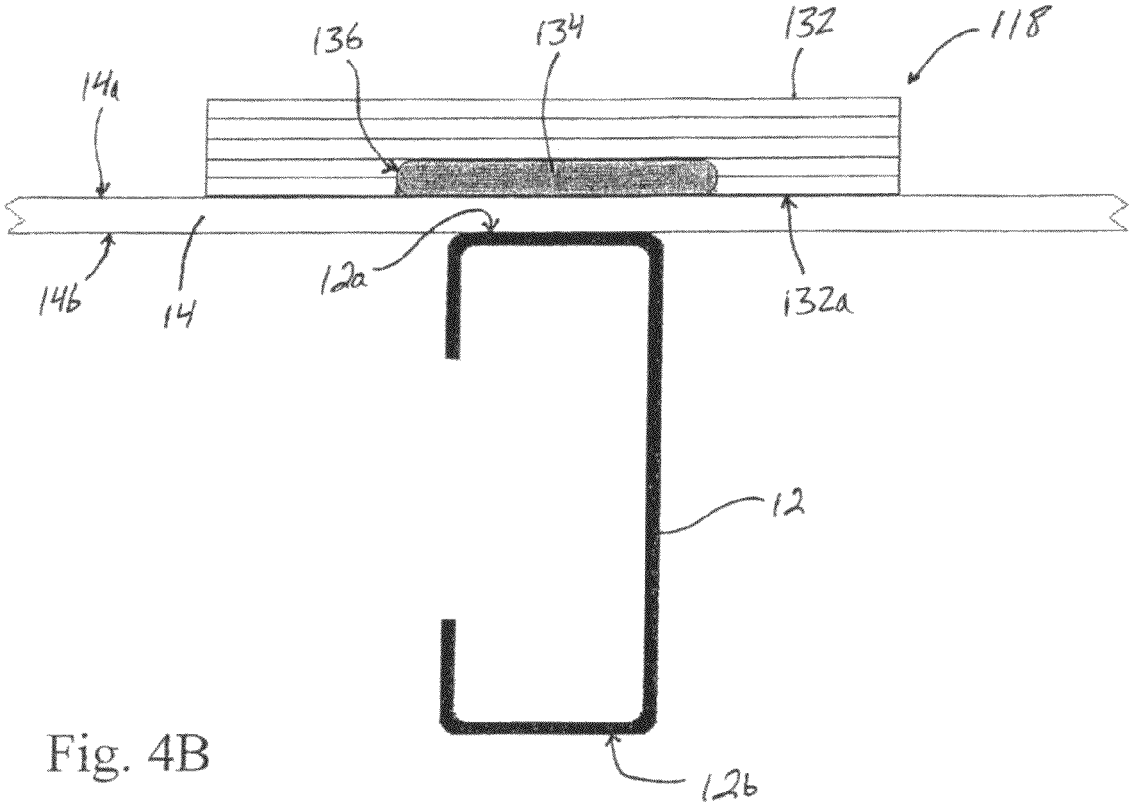
FIG. 4B is a top plan view of a portion of a wall structure similar to that of FIG. 4A and incorporating a different batten.

Optionally, and with reference to FIG. 4B, a batten 118 may include an outer portion 132 formed with an elongate recess 136 instead of an elongate chamber. The recess 136 receives an insulative portion 134 along a surface 132*a* of the outer portion 132 so that the insulative portion 134 is only partially surrounded or encased in the outer portion 132. The side of the batten 118 having the exposed insulative portion 134 is positioned so as to face the stud 12 to maximize the batten's insulative properties at the stud.

Figure 5:
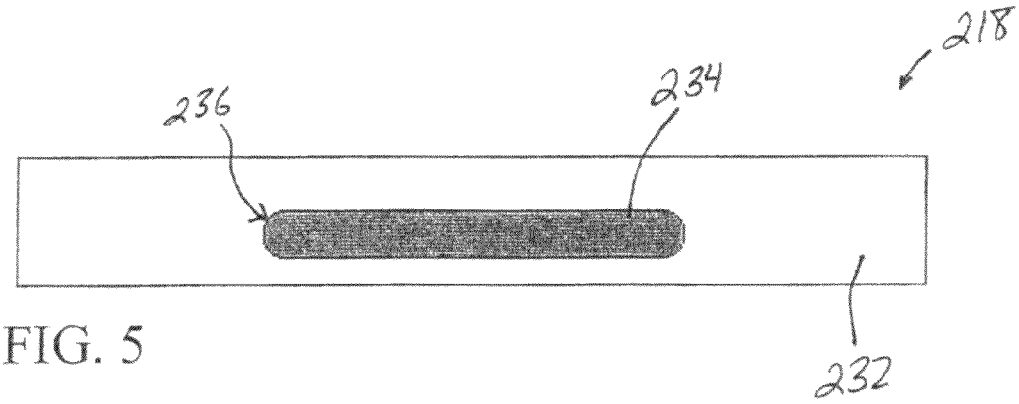
FIG. 5 is a top plan view of an insulated batten having a single-piece structural portion.

Optionally, and with reference to FIG. 5, a batten 218 may be formed from a single-piece solid member or outer portion 232 encasing an insulative portion 234. For example, outer portion 232 may be extruded or molded from a material that hardens or cures with a longitudinal chamber 236 formed along its length, the chamber 236 later receiving insulative portion 234. Alternatively, insulative portion 234 may be incorporated or inserted into outer portion 232 during a substantially continuous extruding process, or may be inserted after an extruding process. For example, batten 218 may be formed in a substantially continuous extrusion process in which outer portion 232 is formed around insulative portion 234 to encase the insulative portion inside the outer portion. In such a process, the material that forms outer portion 232 cures or hardens with insulative portion 234 already disposed in longitudinal chamber 236.

Figure 6A:
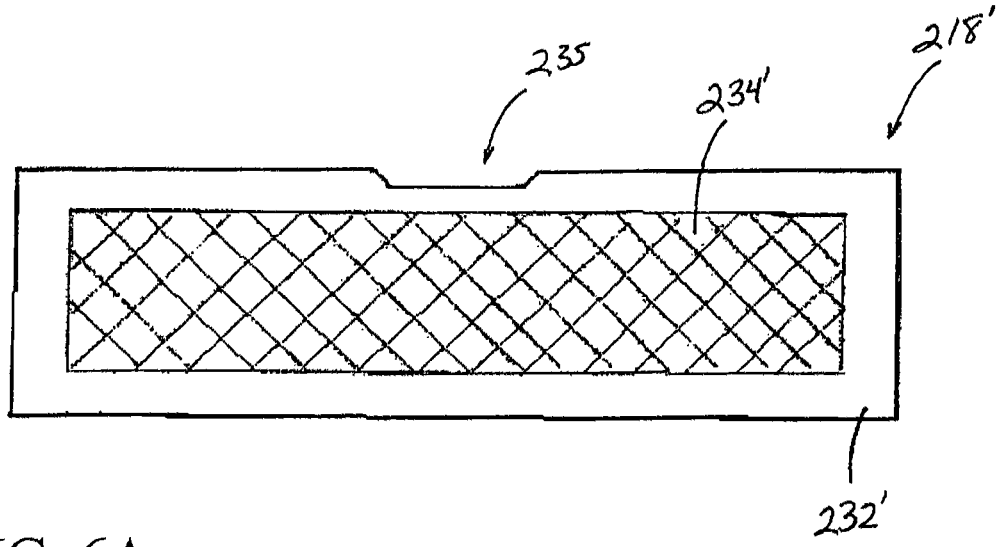
FIG. 6A is a top plan view of another insulated batten having a single-piece structural portion.
Figure 6B:
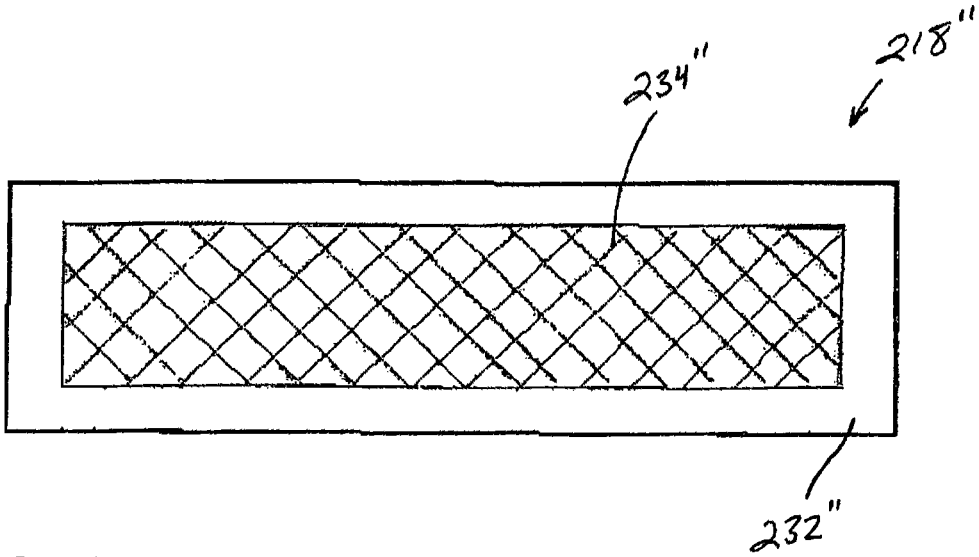
FIG. 6B is a top plan view of an insulated batten similar to that of FIG. 6A.

Optionally, and with reference to FIG. 6A, a batten 218' includes a thin-walled outer portion 232', such as a single-piece outer portion, and a relatively large insulative portion 234'. A groove or channel 235 in outer portion 232' provides a space for fastener heads (such as nail heads, screw heads, or the like) so that the fastener heads do not protrude beyond the outer dimensions of outer portion 232'. Insulative portion 234' generally provides increased resistance to heat flow through batten 218' compared to battens 18, 118, 218, by virtue of the size of its inner insulative portion, and may occupy a majority of the width and height of outer portion 232'. For example, in one preferred embodiment, outer portion 232' may have an overall width of about 4 inches while insulative portion 234' has an overall width of about 3½ inches, with about ¼ inch of outer portion 232' remaining on either side of insulative portion 234'. The overall depth or thickness of outer portion 232' may be approximately 1 inch while the insulative portion 234' has an overall depth or thickness of about ⅝ inch, with about 3/16 inch remaining on either side of insulative portion 234' in the depth direction. Channel 235 may have a depth of about 1/16 inch and a width of about ¾ inch, for example. Optionally, a batten 218" includes a thin-walled outer portion 232" and a relatively large insulative portion 234", but lacks a groove or channel in the outer portion 232" (FIG. 6B).

Accordingly, the present invention provides a building structural component that resists weather while facilitating drying and elimination of water vapor and liquid water from within the component, which may be a wall, a ceiling, a roof, a floor, or the like. The invention further provides an insulated batten for reducing the heat flow through studs in walls, floors, ceilings, roofs, and the like, and facilitates the construction of highly-insulative and weather-resistant structures for building construction. By using insulated battens in combination with a vapor-permeable membrane in a wall structure, for example, the wall may be particularly well-insulated across its entire surface while permitting water vapor to escape through the wall and preventing moisture from entering through the wall. In addition, the insulated battens may be used to replace conventional battens with little or no change to wall or roof structure dimensions, and without requiring special handling or tools.

Changes and modifications in the specifically described embodiments may be carried out without departing from the principles of the present invention, which is intended to be limited only by the scope of the appended claims, as interpreted according to the principles of patent law including the doctrine of equivalents.

The embodiments of the invention in which an exclusive property is claimed are defined as follows:

1. A building structural component comprising:

a plurality of structural stud members in spaced arrangement, said stud members having exterior and interior surfaces;

a sheathing having an exterior and interior surface, said interior surface of said sheathing being positioned along the exterior surfaces of said stud members;

a plurality of thermally insulated battens having exterior and interior surfaces, each of said insulated battens being generally aligned with a respective one of said stud members and positioned along said sheathing, each of said battens comprising an elongate outer portion constructed of waste material with a magnesium based binder defining an elongated cavity extending along substantially the entire length of said outer portion and an elongate thermal insulation portion having an R-value ranging from about 7.7 to about 11.5 filling said elongated cavity and at least partially surrounded by said outer portion;

a vapor-permeable membrane positioned adjacent said battens, said vapor-permeable membrane being substantially impervious to liquids and permeable to gases including water vapor;

an exterior siding member having an interior and exterior surface, said siding member being positioned along the exterior surfaces of said insulated_battens so that said siding member is spaced from said sheathing by said insulated battens, and said exterior surface of said siding member being adapted to resist weather elements; and, a cavity defined between said interior surface of said siding member and said exterior surface of said sheathing.

2. The building structural component of claim 1, wherein said vapor-permeable membrane is positioned along said exterior surface of said sheathing and adjacent said interior surface of said battens.

3. The building structural component of claim 1, further comprising a vent member positioned between said exterior surfaces of said battens and said interior surface of said siding member; said vent member being secured to said battens siding member and adapted to permit ventilation of said cavity.

4. The building structural component of claim 1, wherein the width of said inner insulation portions of said insulated battens equals or exceeds the thicknesses of said structural stud members.

5. The building structural component of claim 4, wherein said insulated battens are approximately 4 inches wide and approximately 1 inch thick.

6. The building structural component of claim 4, wherein said outer portion of said battens is a material taken from a group consisting of wood, fiberboard, and high-density foam or a composite of the same.

7. The building structural component of claim 1, wherein said inner insulation portions are approximately ⅝ inches thick and at least about 3.5 inches wide.

8. The building structural component of claim 1, wherein said inner insulation portion comprises an aerogel.

9. The building structural component of claim 1, wherein said batten outer portion comprises a solid composite manufactured from a group of materials consisting of recycled waste materials and a magnesium-based binder, wood, MDF, resin-based materials, and combinations thereof.

10. The building structural component of claim 1, wherein said outer portion encases said insulation portion.

11. The building structural component of claim 1, wherein said exterior siding member comprises a wall siding material.

12. A building structural component comprising:

a plurality of structural stud members in spaced arrangement, said stud members having exterior and interior surfaces;

a sheathing having an exterior and interior surface, said interior surface of said sheathing being positioned along the exterior surfaces of said stud members;

a plurality of thermally insulated battens having exterior and interior surfaces, each said insulated batten comprising an elongate outer portion manufactured from a group of materials consisting of recycled waste materials and a magnesium-based binder each said insulated batten defining an elongated cavity and an elongate inner insulation portion having an R-value ranging from about 7.7 to about 11.5 disposed in said elongated cavity and at least partially surrounded by said outer portion, each of said insulated battens being thermally resistant and generally aligned with a respective one of said stud members and positioned along a surface of said sheathing such that a surface of each insulated batten faces a surface of said sheathing;

a vapor-permeable membrane mounted adjacent a surface of said insulated battens, said vapor-permeable membrane being substantially impervious to liquids and permeable to gases including water vapor;

an exterior siding member having an interior and exterior surface, said siding member positioned along the exterior surfaces of said insulated battens so that said siding member is spaced from said sheathing by said insulated battens, and said exterior surface of said siding member being adapted to resist weather elements;

a cavity defined between said interior surface of said siding member and said exterior surface of said sheathing; and a vent positioned between said exterior surfaces of said battens and said interior surface of said siding member; said vent being mounted to said battens and adapted to permit ventilation of said cavity.

13. The building structural component of claim 12, wherein said insulated battens outer portion is constructed of a plurality of planar layers which are secured together.

14. A batten for eliminating or reducing thermal shorts in building construction that includes one or more studs, said batten comprising;

an elongated outer portion, said elongated outer portion being constructed of a plurality of layers secured together defining a longitudinal cavity, said outer portion comprising a mixture of recycled waste materials and a magnesium-based binder;

an elongated inner insulation portion, said elongated inner insulation portion being at least partially encased in said outer portion and comprising an aerogel material with thermal conductivity ranging from about 7.7 R value to about 11.5 R value; and said batten when positioned in close proximity adjacent to a side of a stud, reducing the flow of thermal energy through the stud.

15. A batten as claimed in claim 14 wherein said longitudinal cavity is a groove.

16. A batten as claimed in claim 14 wherein said outer portion surrounds said inner insulation portion, said outer portion defining a channel on an exterior outer portion surface of said outer portion with a depth of about 1/16 inch.

* * * * *